US006571074B2

(12) United States Patent
Suzuki et al.

(10) Patent No.: US 6,571,074 B2
(45) Date of Patent: May 27, 2003

(54) IMAGE FORMING APPARATUS

(75) Inventors: Atsushi Suzuki, Shizuoka-ken (JP); Jun Kanamori, Odawara (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/952,018

(22) Filed: Sep. 13, 2001

(65) Prior Publication Data

US 2003/0049047 A1 Mar. 13, 2003

(51) Int. Cl.[7] ..... G03G 15/00
(52) U.S. Cl. ..... 399/124; 399/401
(58) Field of Search ..... 399/124, 125, 399/122, 21, 401; 347/138, 152

(56) References Cited

U.S. PATENT DOCUMENTS

| | | | | |
|---|---|---|---|---|
| 5,255,061 A | * | 10/1993 | Matsuura et al. | 399/124 |
| 5,337,134 A | * | 8/1994 | Sato et al. | 399/124 X |
| 5,787,326 A | * | 7/1998 | Ogawa et al. | 399/124 X |
| 5,839,032 A | * | 11/1998 | Yasui et al. | 399/124 X |
| 5,887,228 A | * | 3/1999 | Motohashi et al. | 399/124 X |
| 6,134,404 A | * | 10/2000 | Iwai et al. | 399/124 X |

FOREIGN PATENT DOCUMENTS

| | | | |
|---|---|---|---|
| JP | 63-244059 | | 10/1988 |
| JP | 63-244064 | | 10/1988 |
| JP | 03-043750 | * | 2/1991 |
| JP | 6-266172 | | 9/1994 |
| JP | 08-190331 | * | 7/1996 |
| JP | 09-281767 | * | 10/1997 |

* cited by examiner

*Primary Examiner*—Sophia S. Chen
(74) *Attorney, Agent, or Firm*—Frishauf, Holtz, Goodman & Chick, P.C.

(57) ABSTRACT

An image forming apparatus is provided which includes an apparatus main body having an opening portion, a cover provided on the apparatus main body and for covering/uncovering the opening portion, an image forming unit that is provided in the apparatus main body and that includes a photosensitive member on which a toner image is formed, a transcribing device provided in the apparatus main body for transferring the toner image from the photosensitive member onto a recording paper, a fixing device provided on the cover and for fixing the toner image on the recording paper, a register roller provided in the apparatus main body for conveying the recording paper to the photosensitive member, and a discharging mechanism provided in the apparatus main body. The discharging device conveys the recording paper on which the toner image has been fixed by the fixing device, and discharges the recording paper from the apparatus main body.

7 Claims, 4 Drawing Sheets

IMAGE FORMING APPARATUS

BACKGROUND OF THE INVENTION

The present invention relates to an image forming apparatus having an electrophotographic system which is used for a printer, etc.

This type of image forming apparatus includes a unit for forming an image in an apparatus main body. The unit has a rotational photosensitive member which is surrounded by a charging device, an exposing device, a developing device, a transcribing device and a fixing device. Then, the charging device electrifies the photosensitive member. The exposing device exposes the photosensitive member, and forms an electrostatic latent image. Developing the electrostatic latent image by the developing device, a toner image is formed on the photosensitive member. The toner image is transferred by the transcribing device onto a recording paper. The fixing device fixes the toner image transferred onto the recording paper.

The apparatus main body includes a register roller mechanism which may have a pair of rollers for conveying a recording paper stocked in a cassette between the photosensitive member and the transcribing device, and output rollers for outputting the recording paper, which has been through out the fixing device, to the outside of the apparatus main body. A conveying path for conveying a recording paper and recording an image thereon is constituted within the apparatus main body.

In the image forming apparatus, while the recording paper is conveyed through the conveying path within the apparatus main body, the movement of the recording paper is stopped for various causes, and the recording paper may be jammed in the conveying path.

For this reason, an opening portion facing to the conveying path is formed in the apparatus main body, and a cover is provided for covering/uncovering opening portion. The parts which surround the conveying path are separately placed on the main body side and on the cover side. Normally, the cover is closed to seal the conveying path. When the recording paper has been jammed, the cover is opened to expose the conveying path, and the parts which surround the conveying path are separated the apparatus main body side and the cover side. Thus, it is easy to take out the recording paper which is jammed in the conveying path.

There are image forming apparatuses known in the prior-art, wherein a photosensitive member is provided in an apparatus main body, a fixing device and a transcribing device are provided on a cover, and one of a pair of register rollers is provided on the cover. Such apparatuses are disclosed in Jpn. Pat. Appln. KOKAI Publication No. 63-244059 and Jpn. Pat. Appln. KOKAI Publication No. 6-266172.

In this structure, however, when the cover is opened, the transcribing device is also moved away from the photosensitive member. Consequently, it is difficult to place the transcribing device at a suitable position relative to the photosensitive member when the cover has been closed, and the transcribing device may not be in a suitable position. Therefore, an image on the photosensitive member may not be transferred on the recording paper in good condition.

Furthermore, as the paired register rollers are separated at the apparatus body side and the cover side, when the cover is closed to contact the paired register rollers with each other, the contact pressure may be unequal in the longitudinal direction of the register rollers, and parallelism may not be maintained. Then, the recording paper may not be conveyed with a suitable position related to the photosensitive member.

Hence, the conventional structure cannot record an image on the recording paper in good condition, and the image quality is deteriorated.

BRIEF SUMMARY OF THE INVENTION

The present invention aims at providing an image forming apparatus which enables a recording paper to be easily removed when it is jammed in a conveying path, and which can record an image on a recording paper in good condition and obtain a high quality image.

In the image forming apparatus of the present invention, when a cover is closed, a transcribing device can be provided at a suitable position relative to a photosensitive member, and a pair of register rollers can be provided in suitable condition.

The present invention may provide an image forming apparatus comprising: an apparatus main body with an opening portion; a cover provided on the apparatus main body, the cover being movable between a sealing position where the opening portion is covered, and an exposing position where the opening portion is uncovered; an image forming unit provided in the apparatus main body and including a photosensitive member on which a toner image is formed; a transcribing device provided in the apparatus main body and transferring the toner image on the photosensitive member onto a recording paper; a fixing device provided on the cover and fixing the toner image on the recording paper; a register roller provided in the apparatus main body and conveying the recording paper to the photosensitive member; and a discharging mechanism disposed in the apparatus main body, conveying the recording paper on which the toner image has been fixed, and discharging the recording paper to the outside of the apparatus main body.

The invention may provide an image forming apparatus comprising: an apparatus main body with an opening portion; a cover provided on the apparatus main body, the cover being movable between a sealing position where the opening portion is covered, and an exposing position where the opening portion is uncovered; an image forming unit provided in the apparatus main body and including a photosensitive member on which a toner image is formed; a transcribing device provided in the apparatus main body and transferring the toner image on the photosensitive member onto a recording paper; a fixing device provided on the cover and fixing the toner image on the recording paper; a register roller provided in the apparatus main body and conveying the recording paper to the photosensitive member; a discharging mechanism provided on the cover, conveying the recording paper on which the toner image has been fixed, discharging the recording paper to the outside of the apparatus main body; and conveying reversely the recording paper toward the cover at the time of double-side recording; and a reverse conveying mechanism provided on the cover and conveying the recording paper, which has been reversely conveyed by the discharging mechanism, toward the register roller.

The invention may provide an image forming apparatus comprising: an apparatus main body with an opening portion; a cover provided on the apparatus main body, the cover being movable between a sealing position where the opening portion is covered, and an exposed position where the opening portion is uncovered; an image forming unit provided in the apparatus main body and including a photosensitive member on which a toner image is formed; a transcribing device provided in the apparatus main body and transferring the toner image on the photosensitive member onto a recording paper; a fixing device provided on the cover and fixing the toner image on the recording paper; a register roller provided in the apparatus main body and conveying the recording paper to the photosensitive member; a discharging mechanism provided on the cover, conveying the recording paper on which the toner image has been fixed by the fixing device, and discharging the recording paper to the outside of the apparatus main body; a manual feeding roller provided in the apparatus main body; and a manual feeding guide provided in the apparatus main body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described with reference to FIGS. 1 to 4.

Figure 1:
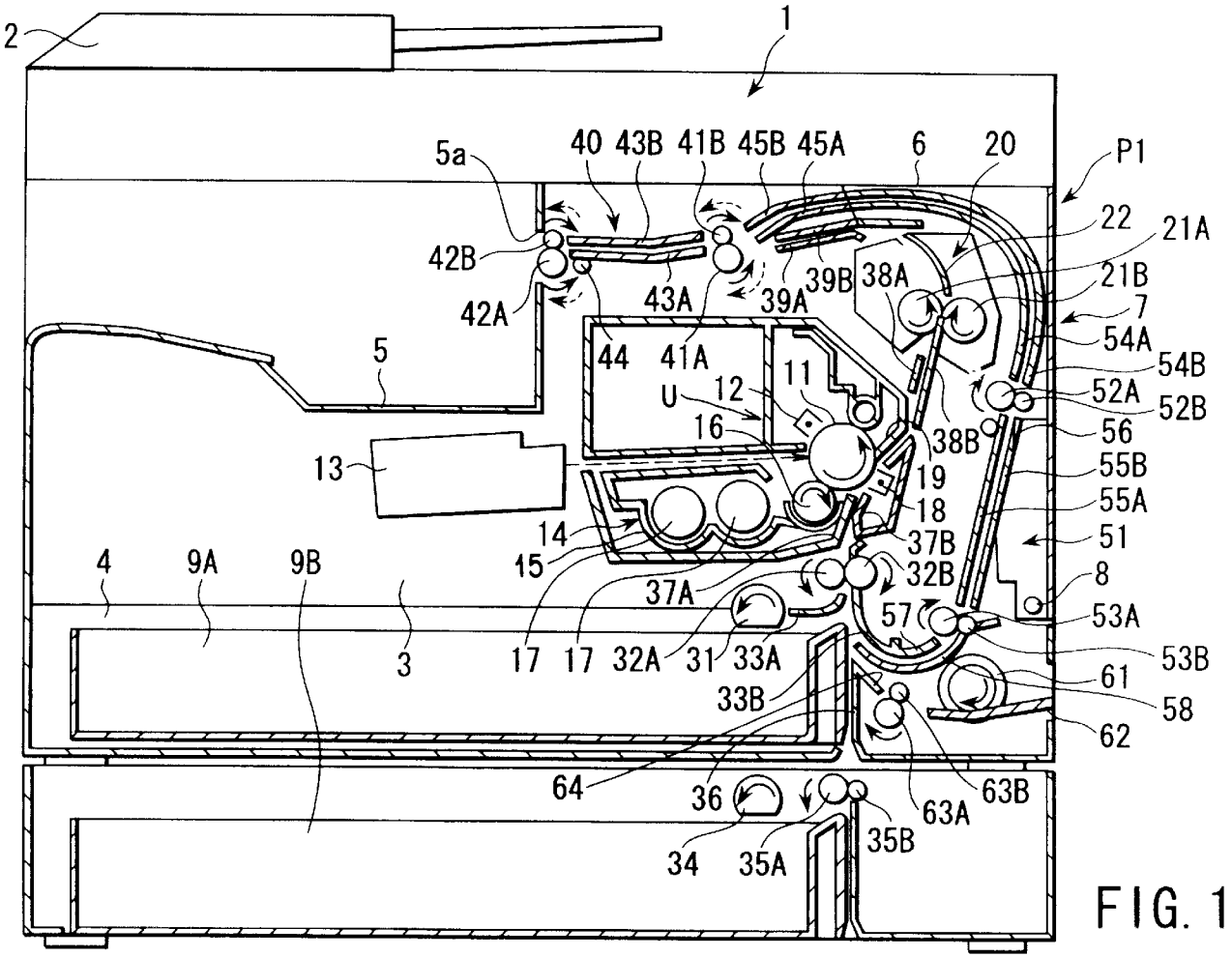
FIG. 1 is a cross-sectional view showing an image forming apparatus according to an embodiment of the present invention.
Figure 2:
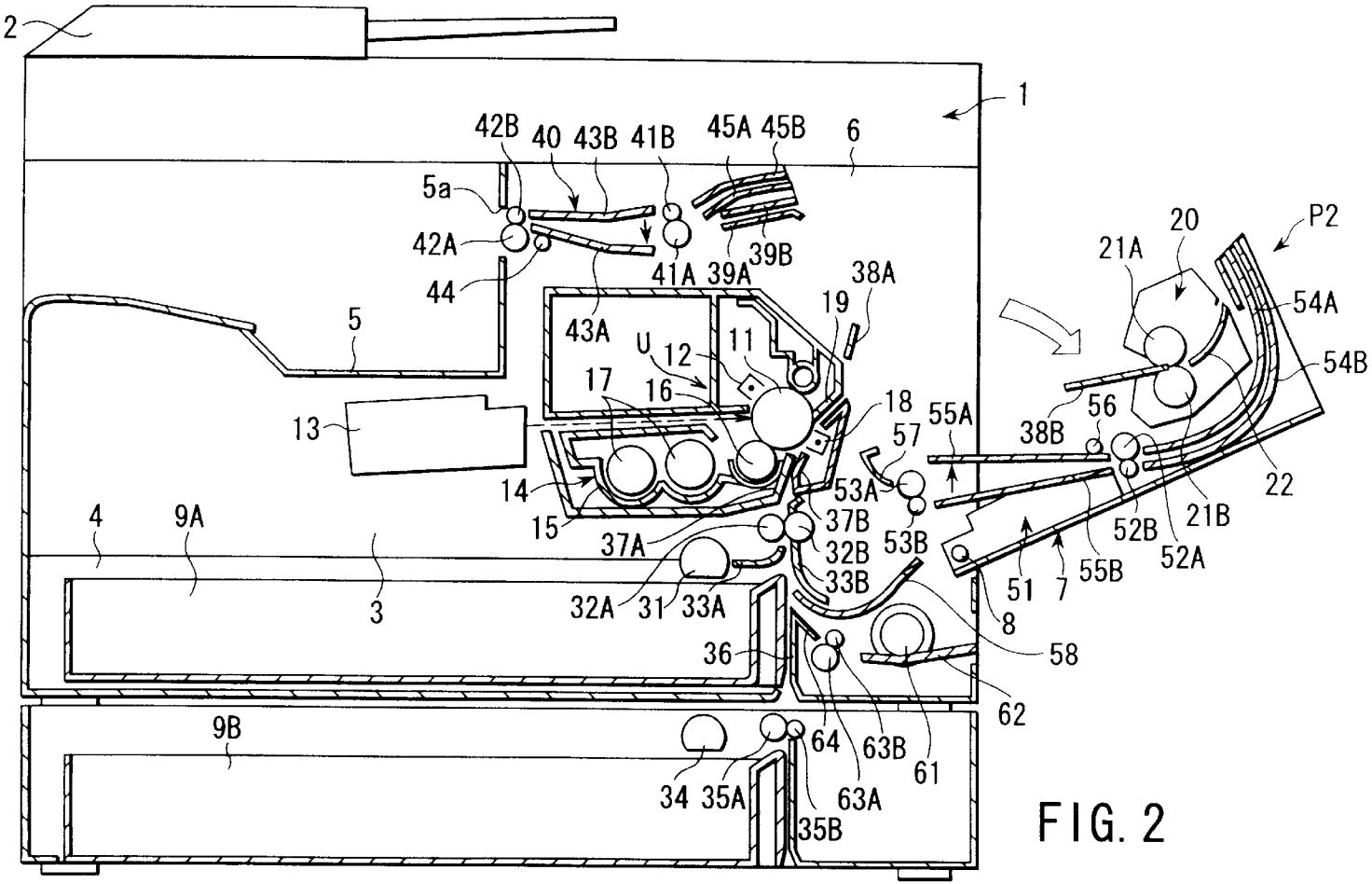
FIG. 2 is a cross-sectional view showing the image forming apparatus according to the embodiment.
Figure 3:
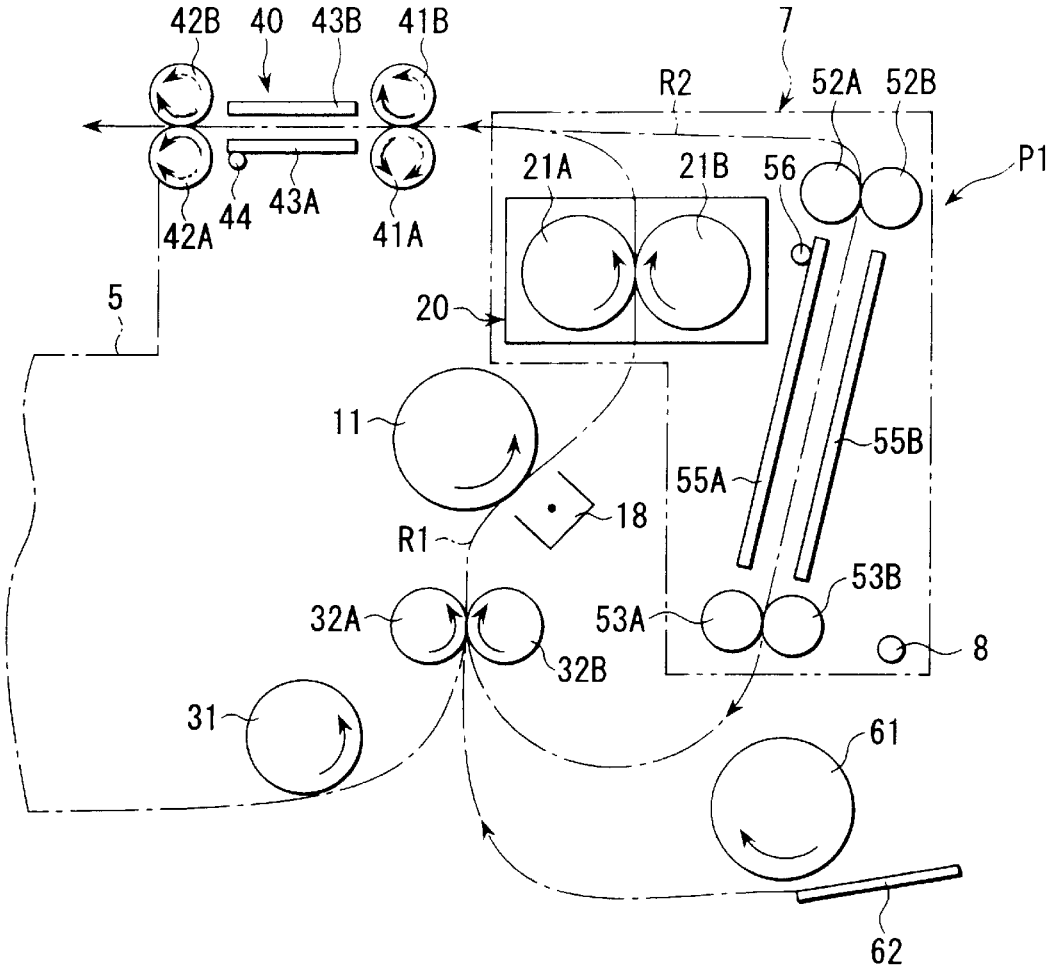
FIG. 3 shows schematically a state in which a cover is closed in the image forming apparatus of the embodiment.
Figure 4:
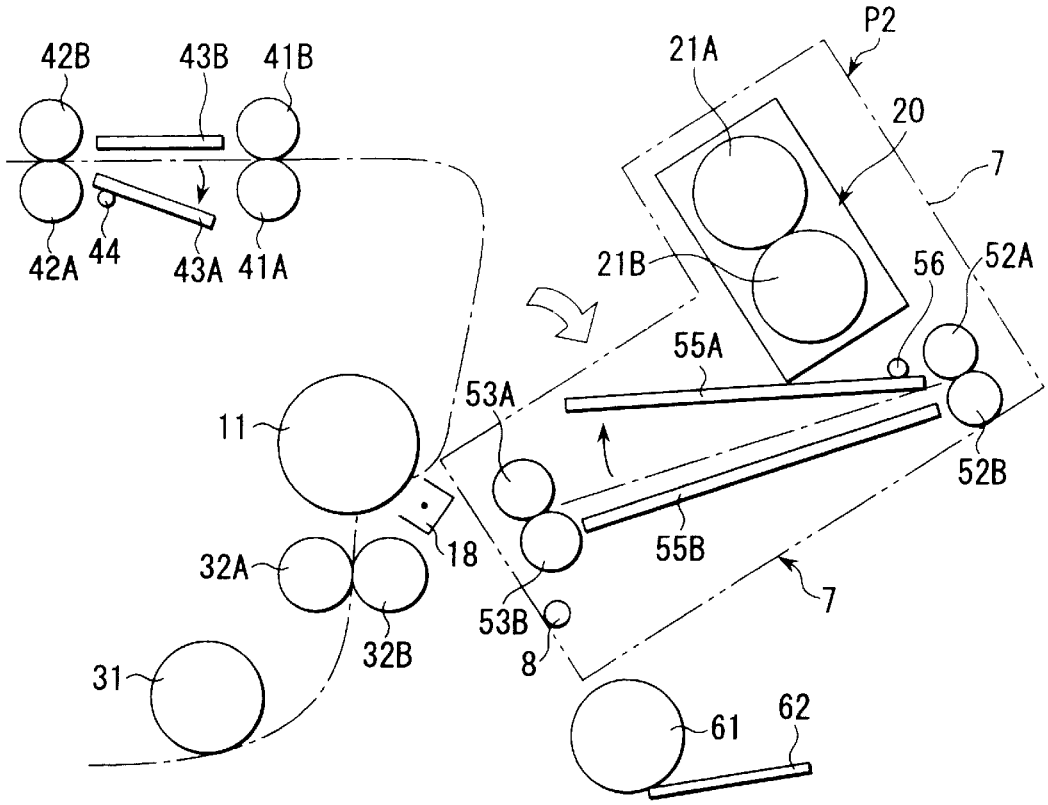
FIG. 4 shows schematically a state in which the cover is opened in the image forming apparatus of the embodiment.

An image forming apparatus according to the embodiment is used as a printer or a copying machine. FIGS. 1 and 2 are cross-sectional views showing the image forming apparatus according to one embodiment of the invention. FIG. 1 shows a state in which a cover is closed, and FIG. 2 shows a state in which the cover is opened. FIG. 3 shows schematically a state in which the cover is closed in the image forming apparatus of the embodiment, and FIG. 4 shows schematically a state in which the cover is opened.

An apparatus main body 1 includes an image reading section 2 in its middle part, an image forming unit containing section 3 in its middle part, and a cassette containing section 4 in its lower part. An output tray 5 is provided in the middle part of the apparatus main body 1. The output tray 5 is adjacent to one side of the image forming unit containing section 3. An output port 5*a* is formed in a wall portion opposed to the output tray 5.

An opening portion 6 is formed at a portion of the middle part of the apparatus main body 1, which is opposite to the output tray 5. The opening portion 6 opens the image forming unit containing section 3. A cover 7 is provided at the opening portion 6. The cover 7 constitutes a part of the walls of the apparatus main body 1 when the opening portion 6 is covered. The cover 7 is supported rotatably on the apparatus main body 1 by a horizontal support shaft 8 at a lower end portion. The cover 7 is rotatable between a sealing position (upright position) P1 where the opening portion 6 is covered and an exposing position (at which the cover falls down to the outside of the apparatus main body 1) P2 where the opening portion 6 is uncovered.

In the cassette containing section 4 of apparatus main body 1, cassettes 9A and 9B, for instance, are arranged vertically in two stages. Each of the cassettes 9A and 9B contains a stack of recording papers (not shown).

An image forming unit U, which forms an image and records it on a recording paper, is contained in the image forming unit containing section 3 of apparatus main body 1. The image forming unit is one of a type, for example, which conveys a recording paper vertically upward from below and records an image thereon. The image forming apparatus of this embodiment is able to record an image on one side or both sides of a recording paper. The paper sheet can be manually fed by a user's operation.

A photosensitive drum 11 is provided horizontally to face the opening portion 6 of apparatus main body 1. The photosensitive drum 11 is rotated in the direction of an arrow by a driving mechanism (not shown). A charging device 12, an exposing device 13, a developing device 14, a transcribing device 18 and a cleaning blade 19 are arranged around the photosensitive drum 11 from the upper side of the photosensitive drum in the direction of rotation of the photosensitive drum. The image forming unit U includes the charging device 12, exposing device 13, developing device 14 and cleaning blade 19.

The charging device 12 electrifies the surface of the photosensitive drum 11. The exposing device 13 exposes the surface of the photosensitive drum 11, and forms an electrostatic latent image. The developing device 14 includes a tank 15 for containing toner, a developing roller 16, and toner supplying rollers 17 for supplying toner to the developing roller 16. The developing roller 16 sticks toner to the surface of the photosensitive drum 11, and forms a toner image. The transcribing device 18, which transfers the toner image on the photosensitive drum 11 onto the recording paper, applies a method using a corona discharge. The transcribing device 18 is provided in the apparatus main body 1 for transferring, locating a suitable position. The cleaning blade 19 removes the toner remaining on the surface of the photosensitive drum 11 after transferring.

A fixing device 20 is placed above the cleaning blade 19 and provided on the cover 7. The fixing device 20 includes a rotatable heating roller 21A and a rotatable pressing roller 21B. The recording paper is passed through between both rollers 21A and 21B, and the toner image transferred on the recording paper is fixed. The fixing device 20 includes a guide 22 for guiding the recording paper.

A first conveying path R1 for conveying a recording paper is constructed as shown in FIG. 3. In the Figure, numeral 31 denotes a sheet feeding roller. The sheet feeding roller 31 is provided in the apparatus main body 1 and feeds a recording paper from the cassette 9A set in the cassette containing section 4. The feeding roller 31 feeds one by one from the top of the recording papers stacked in the cassette 9A. A pair of register rollers 32A and 32B are placed on the upper side of the sheet feeding roller 31 and provided in the apparatus main body 1. One of the paired register rollers 32A and 32B is rotated in the direction of an arrow by a driving mechanism (not shown), and the other is rotated as it contacts with said one roller. A pair of guides 33A and 33B are provided between the sheet feeding roller 31 and paired register rollers 32A and 32B. The recording paper fed by the sheet feeding roller 31 is guided by the guides 33A and 33B, and conveyed upward of the paired register rollers 32A and 32B.

In the apparatus main body 1, a sheet feeding roller 34, a pair of conveying rollers 35A and 35B and a guide 36 are provided. These parts function to convey a recording paper, which is contained in the cassette 9B placed below the cassette 9A, to the paired register rollers 32A and 32B.

A pair of guides 37A and 37B are vertically provided on the upper side and lower side of the photosensitive drum 11 and transcribing device 18. The recording paper is conveyed upward by the paired register rollers 32A and 32B and guided by the paired guides 37A and 37B to pass through vertically between the photosensitive drum 11 and transfer device 18. An image is transferred on the recording paper while the recording paper is passing through between the photosensitive drum 11 and transfer device 18.

A pair of guides 38A and 38B are vertically provided between the photosensitive drum 11 and transcribing device 18, on the one hand, and the fixing device 20, on the other. The guide 38A extending along the photosensitive drum 11 is attached to the apparatus main body 1, and the guide 38B extending along the transfer device 13 is attached to the cover 7. The recording paper, which has passed through between the photosensitive drum 11 and transfer device 18, is guided to the fixing device 20 by the paired guides 38A and 38B.

A pair of guides 39A and 39B are horizontally provided on the upper side of the fixing device 20 in the apparatus main body 1. The guides 39A and 39B guide the recording paper, on which the image has been fixed by the fixing device 20, to a discharging mechanism 40.

The discharging mechanism 40 includes a pair of discharging rollers 41A and 41B, a pair of discharging rollers 42A and 42B, and a pair of guides 43A and 43B, which are provided in the main body 1 and constitute a horizontal conveying path. The paired discharging rollers 41A and 41B are juxtaposed with the guides 39A and 39B. The paired discharging rollers 42A and 42B are placed with a horizontal gap from the paired discharging rollers 41A and 41B so as to face the output port 5*a* of the apparatus main body 1. The paired guides 43A and 43B are placed horizontal between the paired discharging rollers 41A and 41B and the paired discharging rollers 42A and 42B with a vertical gap therebetween. For example, the lower guide 43A is supported by a fulcrum shaft 44 at an end portion which is closer to the output port 5*a* (i.e. an end portion located away from the opening portion 6 of main body 1 and on the downstream side of the direction of conveying the recording paper). The guide 43A rotates on the fulcrum shaft 44 in the vertical direction, and moves toward and away relating to the upper guide 43B. In a normal state, the lower guide 43A is placed near the upper guide 43B to constitute a conveying path for a recording paper. The lower guide 43A is held in this position by a suitable holding means (not shown). When the lower guide 43A is released by the holding means, the guide 43A rotates downward by its own weight and moves away from the guide 43B to expose (increase) the gap therebetween.

As regards the paired discharging rollers 41A, 41B and the paired discharging rollers 42A, 42B, for example, the discharging rollers 41A and 42A are rotated by a driving mechanism (not shown) and the other associated rollers 41B and 42B are rotated in contact with them. When the recording paper is discharged from the output port 5*a* of main body 1 to the output tray 5, the paired discharging rollers 41A, 41B and paired discharging rollers 42A, 42B are rotated in the direction of discharging (the direction of solid-line arrows in the Figure) and conveys the recording paper in the direction of discharging. The paired discharging rollers 41A, 41B and paired discharging rollers 42A, 42B are rotated for a time period corresponding to the length of the recording paper. When double-side printing is performed on the recording paper, the paired discharging rollers 41A, 41B and paired discharging rollers 42A, 42B are rotated in the direction of discharging at first, then the recording paper is conveyed in the direction of discharging until the recording paper has gone out of the fixing device 20. After that, the paired discharging rollers 41A, 41B and paired discharging rollers 42A, 42B are rotated in the reverse direction (the direction of broken-line arrows in the Figure), and the recording paper is conveyed in the reverse direction toward a reverse conveying mechanism 51 on the cover 7.

A pair of guides 45A and 45B are placed horizontally above the guides 39A, 39B. The guides 45A, 45B are provided adjacent to the discharging rollers 41A, 41B of the discharging mechanism 40. The guides 45A, 45B guide the recording paper, which has been conveyed reversely from the discharging mechanism 40, to a reverse conveying path R2 in the cover 7.

The cover 7 will be described. As is shown in FIG. 3, the reverse conveying mechanism 51 is provided on the cover 7. The reverse conveying mechanism 51 constitutes the reverse conveying path R2 for conveying the recording paper, which has been conveyed reversely by the discharging mechanism 40, toward the register rollers 32A, 32B. The reverse conveying mechanism 51 comprises a pair of conveying rollers 52A, 52B, a pair of conveying rollers 53A, 53B, a pair of guides 54A, 54B, a pair of guides 55A, 55B, and a guide 57. The paired conveying rollers 52A, 52B and the paired conveying rollers 53A, 53B are juxtaposed at a middle part of the cover 7 with a vertical gap. As regards the paired conveying rollers 52A, 52B and the paired conveying rollers 53A, 53B, for example, the rollers 52A and 53A are rotated by a driving mechanism (not shown) and the other associated rollers 52B and 53B are rotated in contact with them. A pair of guides 54A and 54B are provided at an upper part of the cover 7. The paired conveying rollers 52A, 52B and the paired conveying rollers 53A, 53B convey the recording paper along the reverse conveying path R2.

The paired guides 54A and 54B guide the recording paper, which has been guided by the guides 45A and 45B, to the paired conveying rollers 52A and 52B in a downwardly curved direction. A pair of guides 55A, 55B are provided vertically between the paired conveying rollers 52A, 52B and the paired conveying rollers 53A, 53B.

For example, the guide 55A placed on the inside of the main body 1 is supported by a fulcrum shaft 56 provided on the cover 7 at an upper end portion. The guide 55A is able to rotate on the fulcrum shaft 56, and moves toward and away relating to the outside guide 55B. In a normal state, the guide 55A is situated beside the outside guide 55B to constitute the recording paper conveying path R2. The guide 55A is held in this position by a suitable holding means (not shown). When the guide 55A is released by the holding means, the guide 55A is rotated away from the guide 55B and is able to expose (increase) the gap therebetween.

The guide 57 guides the recording paper, which has been conveyed by the paired conveying rollers 53A, 53B, to the paired register rollers 32A, 32B of the main body 1. The guide 57 is continuous with the guide 38B provided in the main body 1 and is combined with a guide 58 provided in the main body 1 to guide the recording paper.

Accordingly, when double-side recording is performed, the recording paper is conveyed along the recording sheet feeding path R1 and recorded an image on one side thereof, and then the recording paper is conveyed along the reverse conveying path R2 and fed into the recording sheet feeding path R1 once again. In this case, the side of the recording paper, which is facing the photosensitive drum 11, is turned over. Thus, the recording paper is conveyed along the recording sheet conveying path R1 and is recorded an image on the opposite side of the recording paper.

A manual feeding mechanism for manual feeding of a recording paper by the user is provided in the apparatus main body 1 at a lower part of the cover 7. A recording paper tray (not shown) is attached detachably to the apparatus main body 1. The recording paper tray is situated below the cover 7 in its open position P2. The user sets a stack of the recording paper in the recording paper tray. A manual feeding roller 61 and a manual feeding pressure plate guide 62 are provided in the apparatus main body 1. The feeding roller 61 feeds a recording paper from the recording paper tray. The pressure plate guide 62 presses the recording paper on the feeding roller 61 from below. In the Figure, numerals 63A and 63B denote a pair of conveying rollers, and numeral 64 denotes a guide.

The paired conveying rollers 63A, 63B convey the recording paper, which has been fed by the feeding roller 61, into the apparatus main body 1. For example, the roller 63A is rotated in the direction of conveyance by a driving mechanism (not shown), and the other roller 63B is rotated in contact with the roller 63A. The guide 64 exists for guiding the recording paper to the register rollers 32A, 32B.

In the image forming apparatus with the above structure, when a recording paper is conveyed and is recorded an image thereon, the cover 7 is placed in the sealing position Pi, as shown in FIGS. 1 and 3, and closes the opening portion 6 of main body 1.

In the image forming apparatus, when a recording paper has been jammed in the conveying path, the opening portion 6 is opened, rotating the cover 7 to the open position P2, as shown in FIGS. 2 and 4. When the cover 7 is rotated to the open position, the recording sheet conveying path R1 of main body 1 is separated on the main body 1 side and the cover 7 side in the direction of conveyance. Then, the photosensitive drum 11, transcribing device 18, register rollers 32A, 32B, and guides 37A, 37B are positioned in the apparatus main body 1. The fixing device 20 and guide 38b are separated from the main body 1 along with the cover 7. Thus, the user can easily remove the recording paper jammed in the recording paper conveying path R1. For example, it is easy to remove the recording paper jammed in the fixing device 20. The transfer device 18 is provided on the main body 1 and is not separated from the main body 1 along with the cover 7. Accordingly, the preset position of the transfer device 18 relative to the photosensitive drum 11 can be maintained, irrespective of the closing and opening operations of the cover 7. Therefore, despite the image forming apparatus being composed to have the openable/closable cover, the toner image on the photosensitive drum 11 can be transferred to the recording paper in good condition.

While the paired register rollers 32A and 32B also remain in the apparatus main body 1, they do not separate from the main body 1 along with the cover 7. Thus, the contact pressure and parallelism of the paired register rollers 32A, 32B can be maintained constant, irrespective of the opening and closing operations of the cover 7. Therefore, the paired register rollers 32A and 32B can convey the recording paper to the photosensitive drum at a suitable position.

The manual feeding roller 61 and manual feeding pressure plate guide 62 are provided in the apparatus main body 1. Thus, the performance of the manual feeding operation, in which the user manually feeds the recording paper, is stabilized.

When a recording paper has been jammed in the discharging mechanism 40, it is easy to remove the recording paper for opening the guide 43A. In other words, even where no recording paper has been jammed in the paired conveying rollers 52A, 52B or paired conveying rollers 53A, 53B, the recording paper jammed in the discharging mechanism 40, it is easy to remove the recording paper for increasing the gap between the paired guides 43A and 43B.

When a recording paper has been jammed in the reverse conveying path R2 of the cover 7, it is easy to remove the recording paper for exposing the guide 55A and opening the gap between the paired guides 43A and 43B.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an apparatus main body with an opening portion;

a cover provided on the apparatus main body, the cover being movable between a sealing position where the opening portion is covered, and an exposing position where the opening portion is uncovered;

an image forming unit provided in the apparatus main body and including a photosensitive member on which a toner image is formed;

a transcribing device provided in the apparatus main body and transferring the toner image on the photosensitive member onto a recording paper;

a fixing device provided on the cover and fixing the toner image on the recording paper;

a register roller provided in the apparatus main body and conveying the recording paper to the photosensitive member; and a discharging mechanism provided in the apparatus main body and including a pair of guides with a gap therebetween that is enabled to be exposed by moving one of said pair of guides away from the other of said pair of guides, the discharging mechanism conveying the recording paper on which the toner image has been fixed, and discharging the recording paper from the apparatus main body.

2. An image forming apparatus according to claim 1, wherein the discharging mechanism reversely conveys the recording paper toward the cover at a time of double-side recording, and wherein the image forming apparatus further comprises:

a reverse conveying mechanism provided on the cover and conveying the recording paper, which has been reversely conveyed by the discharging mechanism, toward the register roller.

3. An image forming apparatus according to claim 2, wherein the reverse conveying mechanism is enabled to be exposed and includes a guide which guides the recording paper.

4. An image forming apparatus according to claim 2, further comprising:

a pair of discharging guides which guide the recording paper on which the image has been fixed by the fixing device to the discharging mechanism; and a pair of reversing guides which are arranged above the pair of discharging guides, and which guide the recording paper conveyed reversely from the discharging mechanism to the reverse conveying mechanism.

5. An image forming apparatus according to claim 2, wherein the discharging mechanism conveys the recording paper on which the toner image has been fixed by the fixing device and discharges the recording paper from the apparatus main body irrespective of whether the cover is in the sealing position or exposing position.

6. An image forming apparatus according to claim 1, wherein the discharging mechanism conveys the recording paper on which the toner image has been fixed by the fixing device and discharges the recording paper from the apparatus main body irrespective of whether the cover is in the sealing position or exposing position.

7. An image forming apparatus comprising:

an apparatus main body with an opening portion;

a cover provided on the apparatus main body, the cover being movable between a sealing position where the opening portion is covered, and an exposing position where the opening portion is uncovered;

an image forming unit provided in the apparatus main body and including a photosensitive member on which a toner image is formed;

a transcribing device provided in the apparatus main body and transferring the toner image on the photosensitive member onto a recording paper;

a fixing device provided on the cover and fixing the toner image on the recording paper;

a register roller provided in the apparatus main body and conveying the recording paper to the photosensitive member;

a discharging mechanism provided in the apparatus main body, the discharging mechanism conveying the recording paper on which the toner image has been fixed by the fixing device, and discharging the recording paper from the apparatus main body;

a manual feeding roller provided in the apparatus main body; and a manual feeding guide provided in the apparatus main body.

* * * * *